US011871780B2

(12) United States Patent
Besso et al.

(10) Patent No.: US 11,871,780 B2
(45) **Date of Patent: *Jan. 16, 2024**

(54) SMOKING ARTICLE WITH MANUALLY RELEASABLE ODORANT

(71) Applicant: Philip Morris USA Inc., Richmond, VA (US)

(72) Inventors: Clement Besso, Neuchatel (CH); Anne Wyss-Peters, Lausanne (CH); Charles Kuersteiner, Jouxtens-Mezery (CH)

(73) Assignee: PHILIP MORRIS USA INC., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/238,663

(22) Filed: Apr. 23, 2021

(65) Prior Publication Data

US 2021/0235743 A1 Aug. 5, 2021

Related U.S. Application Data

(63) Continuation of application No. 16/839,758, filed on Apr. 3, 2020, now Pat. No. 10,986,860, which is a (Continued)

(30) Foreign Application Priority Data

Nov. 1, 2005 (EP) ..... 05256762

(51) Int. Cl.
*A24D 1/02* (2006.01)
*A24B 15/28* (2006.01)
*A24D 3/04* (2006.01)

(52) U.S. Cl.
CPC ..... *A24B 15/283* (2013.01); *A24B 15/282* (2013.01); *A24D 1/02* (2013.01); *A24D 3/048* (2013.01)

(58) Field of Classification Search
None
See application file for complete search history.

(56) References Cited

U.S. PATENT DOCUMENTS 3,006,347 A 10/1961 Keaton
3,390,686 A 7/1968 Irby et al.
(Continued)

FOREIGN PATENT DOCUMENTS

CH 648733 A5 4/1985
GB 1194572 A 6/1970
(Continued)

OTHER PUBLICATIONS

EPO Search report for Application No. 05256762.5 to Besso et al. dated Jan. 31, 2006.
(Continued)

*Primary Examiner* — Cynthia Szewczyk
(74) *Attorney, Agent, or Firm* — Harness, Dickey & Pierce, P.L.C.

(57) ABSTRACT

A smoking article has an outer surface and a plurality of frangible microcapsules provided on the outer surface, wherein the microcapsules are capable of being manually ruptured by a consumer to release an odorant encapsulated therein. The smoking article preferably comprises a wrapped tobacco rod; and a filter attached to the wrapped tobacco rod by tipping paper, a mouth end portion of which is "over tipped" with a band or strip of "Peel and Sniff" microcapsules and/or a band or strip of "Scratch and Sniff" microcapsules.

11 Claims, 1 Drawing Sheet

Related U.S. Application Data continuation of application No. 16/227,229, filed on Dec. 20, 2018, now Pat. No. 10,617,145, which is a continuation of application No. 15/695,419, filed on Sep. 5, 2017, now Pat. No. 10,188,138, which is a continuation of application No. 14/719,459, filed on May 22, 2015, now Pat. No. 9,770,050, which is a continuation of application No. 11/590,883, filed on Nov. 1, 2006, now Pat. No. 9,060,545.

(56) References Cited

U.S. PATENT DOCUMENTS

| | | | | |
|---|---|---|---|---|
| 3,587,573 | A | 6/1971 | Flack | |
| 4,606,956 | A | 8/1986 | Charbonneau et al. | |
| 4,617,945 | A | 10/1986 | Vos | |
| 4,687,008 | A * | 8/1987 | Houck, Jr. | A24D 3/061 131/194 |
| 4,854,332 | A | 8/1989 | Hanakura | |
| 4,881,555 | A | 11/1989 | Bolt | |
| 4,889,144 | A | 12/1989 | Tateno et al. | |
| 5,472,002 | A | 12/1995 | Covarrubias | |
| 5,479,949 | A | 1/1996 | Battard et al. | |
| 5,492,568 | A | 2/1996 | Warmerdam et al. | |
| 6,079,418 | A * | 6/2000 | Russo | A24B 15/301 131/276 |
| 2007/0051383 | A1 | 3/2007 | Woods | |
| 2007/0095359 | A1 * | 5/2007 | Kang | A24C 1/00 131/365 |
| 2008/0029111 | A1 | 2/2008 | Dube | |
| 2008/0142028 | A1 | 6/2008 | Fagg | |

FOREIGN PATENT DOCUMENTS

| | | | |
|---|---|---|---|
| GB | 1204018 | A | 9/1970 |
| GB | 1216574 | A | 12/1970 |
| JP | 64-06363 | | 3/1989 |
| JP | 2001017152 | A | 1/2001 |
| JP | 2006509508 | | 3/2006 |
| JP | 2008507972 | | 3/2008 |
| KR | 20000025596 | A | 5/2000 |
| SU | 701519 | A3 | 11/1979 |
| WO | WO-03/009711 | A1 | 2/2003 |
| WO | WO-2004052128 | A2 | 6/2004 |
| WO | WO-2006/020098 | | 2/2006 |

OTHER PUBLICATIONS

International Search Report and Written Opinion dated Jun. 27, 2007 for PCT/IB2006/003947.

International Preliminary Report on Patentability dated May 6, 2008 for PCT/IB2006/003947.

Decision Grant dated Sep. 30, 2010 for Russian Application No. 2008121971.

Office Action dated Mar. 15, 2013 in Korean Application No. 10-2008-7012852.

Office Action dated May 1, 2008 in Japanese Application No. 2008-538456.

Decision of Grant dated Sep. 30, 2010 for Russian Application No. 2008121971.

* cited by examiner

SMOKING ARTICLE WITH MANUALLY RELEASABLE ODORANT

CROSS-REFERENCE TO RELATED APPLICATIONS

This is a continuation of U.S. patent application Ser. No. 16/839,758 filed Apr. 3, 2020, which is a continuation of U.S. patent application Ser. No. 16/227,229 filed Dec. 20, 2018, which is a continuation of U.S. patent application Ser. No. 15/695,419 filed Sep. 5, 2017, which is a continuation of U.S. patent application Ser. No. 14/719,459 filed on May 22, 2015, which is a application of U.S. patent application Ser. No. 11/590,883 filed Nov. 1, 2006 which claims priority under 35 U.S.C. § 119 to, European Application No. 05256762.5, filed Nov. 1, 2005, the entire contents of each of which are incorporated herein by reference.

The present invention relates to a smoking article with manually releasable odorant and more specifically to a smoking article having a plurality of frangible microcapsules provided on the outer surface thereof.

To enable consumers to sample the scents and aromas of products such as perfumes, toiletries, household detergents, beverages and foodstuffs, it is known to provide micro-encapsulated fragrances on promotional material or packaging, which can be released on demand by the consumer. In "Peel and Sniff" sampling systems an aroma is released by the consumer physically separating two strips of film, paper or other material between which the micro-encapsulated fragrance has been deposited. Separation of the strips ruptures the microcapsules containing the fragrance, thereby releasing the aroma to the consumer. In "Scratch and Sniff" sampling systems an aroma is released by the consumer scratching or rubbing paper, film or other material to which the micro-encapsulated fragrance has been applied. The friction generated by the scratching or rubbing ruptures the walls of the microcapsules containing the fragrance, thereby releasing the aroma to the consumer.

Smoking articles including flavourants that are manually released by a consumer to modify the smoking characteristics of the smoking article are known in the art.

For example, U.S. Pat. No. 4,687,008 discloses a variable length filter cigarette that includes flavorant generating means adapted to release varying amounts of flavorant into the smoke in response to lengthening and shortening of the cigarette. In one embodiment, crushable capsules of flavorant are provided between the filter plug and the cigarette rod of the cigarette. In use, as the filter plug is moved toward the rod by the consumer, the capsules are burst releasing the flavorant. In an alternative embodiment, microcapsules are coated onto the inside of the tipping paper. In use, the microcapsules are ruptured by friction as the filter plug is moved toward and away from the cigarette rod by the consumer.

It would, however, be desirable to provide a smoking article that is capable of delivering an enhanced olfactory sensation to a consumer without modifying the flavour or other characteristics of the mainstream smoke produced during combustion of the smoking article.

According to the present invention there is provided a smoking article having an outer surface and a plurality of frangible microcapsules provided on the outer surface, wherein the frangible microcapsules are capable of being manually ruptured by a consumer to release an odorant encapsulated therein.

Throughout the specification "odorant" is used to mean any substance capable of producing an olfactory sensation and includes, but is not limited, to scents, fragrances, perfumes, deodorants and flavourants. Preferably, the odorant produces both a gustatory and an olfactory sensation.

The number of frangible microcapsules provided on the outer surface of smoking articles according to the present invention and the amount of odorant encapsulated therein is such that by manually rupturing the microcapsules the consumer releases sufficient odorant to produce an olfactory sensation. The exact quantity of frangible microcapsules required to produce a perceptible aroma when ruptured will depend not only on the size of the microcapsules, but also the nature and concentration of the encapsulated odorant. Smoking articles according to the present invention may have several thousand frangible microcapsules provided on the surface thereof, for example at least about 5,000 or at least about 10,000 frangible microcapsules.

Preferably, the frangible microcapsules have a diameter of between about 5 microns and about 30 microns.

By rupturing the frangible microcapsules provided on the outer surface of the smoking article manually, rather than, for example, through combustion of the smoking article, the consumer is advantageously able to release the odorant encapsulated therein in a controlled manner into the air surrounding the smoking article before, during and/or after smoking. Smoking articles according to the present invention thereby provide the consumer with an enhanced olfactory sensation, without modifying the flavour or other characteristics of the mainstream smoke produced during combustion thereof.

The frangible microcapsules provided on the outer surface of the smoking article may be capable of being manually ruptured by the consumer applying a physical force thereto using their hands and/or by the consumer applying a physical force thereto using part of a container in which the smoking article is packaged, a coin or another tool.

Encapsulated odorants that may be useful for the present invention include, for example, essential oils, oleoresins, absolutes, fruit concentrates, fruit extracts, distillates and natural-artificial chemicals. Examples of flavourants that may be used are tobacco, cinnamon, spearmint, peppermint, vanilla, orange, peach, blueberry, strawberry, cranberry, geranium extract, linalool, coffee, chocolate, menthol, *eucalyptus*, clove, ginger and citrus.

The plurality of frangible microcapsules provided on the outer surface of the smoking article of the invention may contain the same or different odorants and each microcapsule may have more than one odorant encapsulated therein. The encapsulated odorants may be natural or synthetic. Preferably, the encapsulated odorant is one or more essential oils. Encapsulated odorants suitable for use in smoking articles according to the present invention are known in the art and commercially available from companies such as Arcade Marketing, Inc., New York, USA.

Preferably, the frangible microcapsules are provided on the outer surface of a portion of the smoking article that, in use, is not combusted. Preferably, the microcapsules are provided on the outer surface of a mouth end portion of the smoking article.

Frangible microcapsules may be applied to the outer surface of smoking articles according to the invention by, for example, gravure or offset printing a suspension of the microcapsules directly onto the outer surface of the assembled smoking articles. Alternatively or in addition, frangible microcapsules may be applied to the outer surface of one or more of the components of the smoking article prior to assembly thereof. For example, at least some of the plurality of frangible microcapsules may be printed or otherwise deposited on the outer surface of a layer of paper, film or other sheet material, which circumscribes at least a portion of the smoking article.

At least some of the plurality of frangible microcapsules provided on the outer surface of smoking articles according to the present invention may be initially covered by a removable layer of paper, film or other sheet material, which is releasably affixed to the outer surface of the smoking article. For example, in embodiments of the invention, frangible microcapsules may be provided on the outer surface of a first layer of paper, film or other sheet material, which circumscribes at least a portion of the smoking article, and at least some of the frangible microcapsules provided on the outer surface of the first layer of sheet material may be covered by a removable second layer of paper, film or other sheet material, which is releasably affixed to the outer surface of the first layer of sheet material.

Where the microcapsules are deposited on or between layers of paper, film or other sheet material, the outer surfaces of the layers of sheet material may be printed with, for example, manufacturer or brand logos, trade marks and slogans, the name or a graphical representation of the encapsulated odorant and/or with other consumer information or indicia.

The frangible microcapsules may be capable of being ruptured upon application of a frictional force to the outer surface of the smoking article by the consumer ("Scratch and Sniff").

Alternatively or in addition, where at least some of the plurality of frangible microcapsules are covered by a removable layer of material, which is releasably affixed to the outer surface of the smoking article, the frangible microcapsules may be capable of being ruptured upon removal of the removable layer of material from the outer surface of the smoking article by the consumer ("Peel and Sniff"). For example, in embodiments of the invention where frangible microcapsules provided on the outer surface of a first layer of material, which circumscribes at least a portion of the smoking article, are covered by a removable second layer of material, which is releasably affixed to the outer surface of the first layer of material, the frangible microcapsules may be capable of being ruptured upon separation of the removable second layer of material from the first layer of material by the consumer.

Preferably, the smoking article is a filter cigarette. Preferably, the smoking article comprises a wrapped tobacco rod and a filter attached to the wrapped tobacco rod by tipping paper. In embodiments of the invention, frangible microcapsules may be provided on the outer surface of the tipping paper. Alternatively or in addition, frangible microcapsules may be provided on the outer surface of a layer of material circumscribing at least a portion of the tipping paper.

The smoking article may be "over tipped" with either a band or strip of "Peel and Sniff" or a band or strip of "Scratch and Sniff" microcapsules that circumscribes a mouth end portion of the tipping paper. In other embodiments, the smoking article may be "over tipped" with either a band or strip of "Peel and Sniff" or a band or strip of "Scratch and Sniff" microcapsules that circumscribes a distal end portion of the tipping paper, distant from the mouth end thereof. In yet further embodiments, the smoking article may be "over tipped" with either a band or strip of "Peel and Sniff" or a band or strip of "Scratch and Sniff" microcapsules that circumscribes the full length of the tipping paper from the mouth end to the distal end thereof.

Alternatively, the smoking article may be "over tipped" with both a band or strip of "Peel and Sniff" and a band or strip of "Scratch and Sniff". In such embodiments of the invention, the band or strip of "Peel and Sniff" microcapsules may circumscribe a mouth end region of the tipping paper, while the band or strip of "Scratch and Sniff" microcapsules circumscribes a distal end portion of the tipping paper, distant from the mouth end thereof or vice versa. In both cases, the length of the tipping paper circumscribed by the band or strip of "Peel and Sniff" and the length of the tipping paper circumscribed by the band or strip of "Scratch and Sniff" microcapsules may be varied.

Where the smoking article is "over tipped" with a band or strip of "Peel and Sniff" or "Scratch and Sniff" microcapsules that circumscribes at least a mouth end portion of the tipping paper, the band or strip of "Peel and Sniff" or "Scratch and Sniff" may also cover the mouth end face of the filter.

In alternative embodiments of the invention, the bands or strips of "Scratch and Sniff" microcapsules described above may be formed by printing a suspension of the microcapsules directly onto the outer surface of the tipping paper, rather than by "over tipping" the filter with a layer of sheet material on which the "Scratch and Sniff" microcapsules are deposited.

The invention will be further described, by way of example only, with reference to the accompanying drawings in which.

Figure 1:
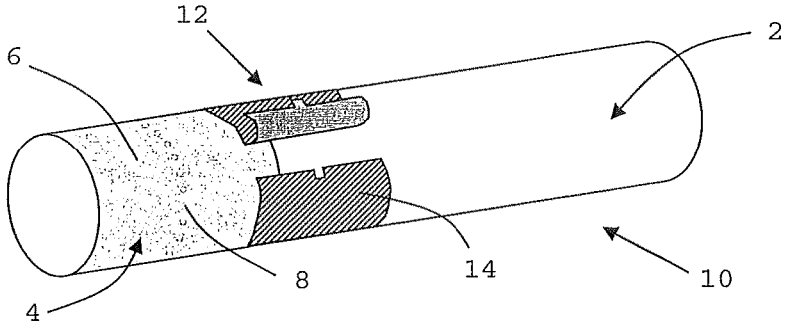
FIG. 1 shows a perspective view of a filter cigarette according to a first embodiment of the invention.

The filter cigarettes according to the first, second, third and fourth embodiments of the invention shown in FIGS. 1, 2, 3 and 4 respectively, have several components in common; these components have been given the same reference numerals throughout.

Each filter cigarette generally comprises an elongate, cylindrical, wrapped, tobacco rod 2 attached at one end to an axially aligned cylindrical filter 4. The wrapped tobacco rod 2 and the filter 4 are joined in a conventional manner to form the filter cigarette by tipping paper 6, which circumscribes the entire length of the filter 4 and an adjacent, mouth-end portion of the wrapped tobacco rod 2. To ventilate the mainstream smoke produced during combustion of the smoking article, a ring of perforations 8 is provided through the tipping paper 6 at a location along the filter 4.

As shown in FIG. 1, the filter cigarette 10 according to the first embodiment of the invention further comprises a laminated strip or band 12, which circumscribes the end of the tipping paper 6 proximate the tobacco rod 2 and the end of the wrapped tobacco rod 2 proximate the tipping paper 6. The laminated band 12 includes a lower paper layer, the underside of which is adhered to the tipping paper 6 and wrapped tobacco rod 2, and a removable upper paper layer 14, the underside of which is releasably adhered to the lower paper layer; to show the position of the band 12 with respect to the wrapped tobacco rod 2, filter 4 and tipping paper 6 of the filter cigarette 10, the lower paper layer has been omitted from FIG. 1. A micro-encapsulated odorant is deposited on the lower paper layer, between the outer surface of the lower paper layer and the inner surface of the removable upper paper layer 14.

In use, in order to release the encapsulated odorant, the consumer may separate the removable upper paper layer 14 from the lower paper layer of the laminated band 12 either before, during or after smoking. The relative strength of adhesion between the various components of the laminated band 12 is such that removal of the upper paper layer 14 ruptures the walls of the microcapsules deposited between the inner surface of the removable upper paper layer 14 and the outer surface of the lower paper thereby releasing the odorant encapsulated therein.

Figure 2:
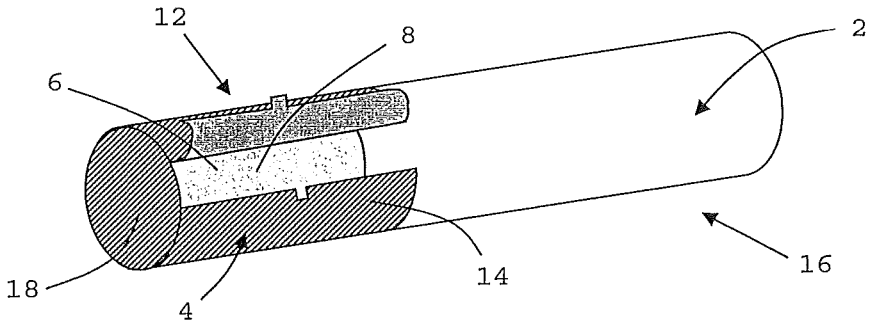
FIG. 2 shows a perspective view of a filter cigarette according to a second embodiment of the invention.

The filter cigarette 16 according to the second embodiment of the invention is of largely similar construction to the filter cigarette 10 shown in FIG. 1. As shown in FIG. 2, the laminated band 12 in this embodiment, however, circumscribes the entire length of the tipping paper 6 and the end of the wrapped tobacco rod 2 proximate the tipping paper 6. In use, to release the encapsulated odorant the consumer separates the removable upper paper layer 14 of the laminated band 12 from the remainder thereof as previously described. By increasing the proportion of the tipping paper 6 and hence surface of the filter cigarette that is circumscribed by the laminated band 12 in the second embodiment shown in FIG. 2, the number of microcapsules provided on the outer surface of the filter cigarette 16 may be increased. In use, when the upper layer 14 of the laminated band 12 is removed, a greater quantity of encapsulated odorant may thereby be released from the microcapsules and hence a more intense olfactory sensation potentially provided to the consumer than in the first embodiment of the invention shown in FIG. 1.

In addition to the tipping paper 6 and the end of the wrapped tobacco rod 2 proximate thereto, in the filter cigarette 16 according to the second embodiment of the invention the removable upper layer 14 of the laminated band 12 also covers the mouth-end 18 of the filter 4. The laminated band 12 thereby advantageously provides a removable "seal", which overlies the mouth-end 18 of the filter cigarette 16 prior to smoking. Furthermore, as in order to smoke the filter cigarette 16 the consumer must break the "seal" by removing the upper layer 14 of the laminated band 12, the second embodiment of the invention ensures that the encapsulated odorant is released by the consumer prior to smoking.

Figure 3:
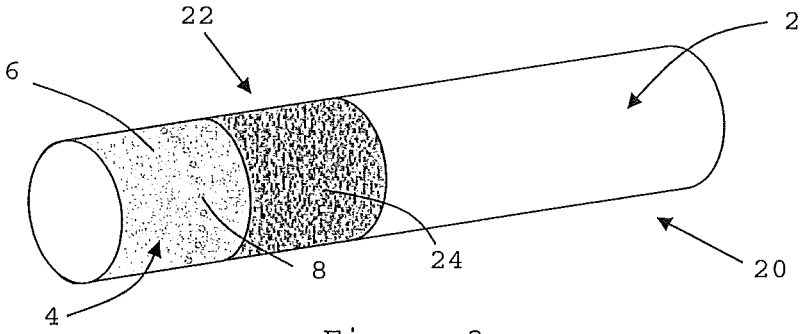
FIG. 3 shows a perspective view of a filter cigarette according to a third embodiment of the invention.

The filter cigarette 20 according to the third embodiment of the invention shown in FIG. 3 comprises a band 22, which circumscribes the end of the tipping paper 6 proximate the tobacco rod 2 and the end of the wrapped tobacco rod 2 proximate the tipping paper 6. The band 22 includes a paper layer 24 having a micro-encapsulated odorant deposited thereon, the underside of which is adhered to the tipping paper 6 and wrapped tobacco rod 2.

In use, either before, during or after smoking the consumer may rub or scratch the outer surface of the paper layer 24 of the band 22 directly using their fingers or indirectly using, for example, part of the packaging for the cigarette to release the encapsulated odorant from the band 22. The rubbing or scratching generates a frictional force that breaks the microcapsules deposited on the outer surface of the paper layer 24 thereby releasing the odorant encapsulated therein. Positioning of the band 22 at the end of the tipping paper 6 proximate the wrapped tobacco rod 2, where the consumer will typically hold the filter cigarette 20 during smoking, advantageously allows at least some of the microcapsules deposited on the outer surface of the paper layer 24 to be broken through normal handling of the filter cigarette 20 by the consumer. Furthermore, the encapsulated odorant deposited on the outer surface of the paper layer 24 of the second band 22 may be advantageously transferred to the consumer's fingers during smoking of the filter cigarette 20.

It will be appreciated that, if desired, the band 22 of the filter cigarette 20 according to the third embodiment of the invention could be extended to circumscribe the entire length of the tipping paper 6 and the end of the wrapped tobacco rod 2 proximate the tipping paper 6, like the laminated band 12 of the filter cigarette 16 according to the second embodiment of the invention shown in FIG. 2.

Figure 4:
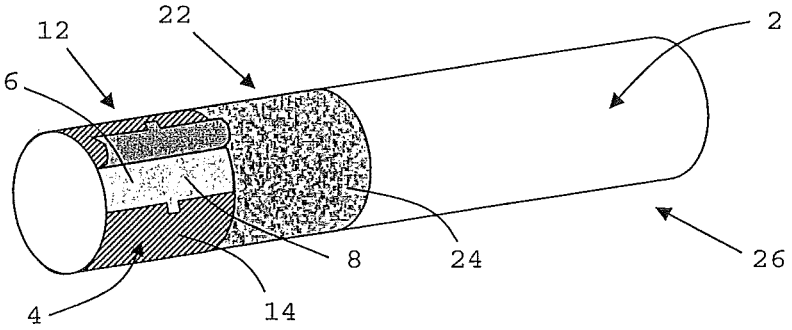
FIG. 4 shows a perspective view of a filter cigarette according to a fourth embodiment of the invention.

The filter cigarette 26 according to the fourth embodiment of the invention shown in FIG. 4 comprises a laminated first band 12, which circumscribes the end of the tipping paper 6 proximate the mouth-end of the filter cigarette 30. The laminated first band 12 has the same construction and function as the laminated bands 12 of the filter cigarettes 10, 16 according to the first and second embodiments of the invention respectively, shown in FIGS. 1 and 2 and previously described above. As shown in FIG. 4, the filter cigarette 26 further comprises a second band 22, which circumscribes the end of the tipping paper 6 proximate the wrapped tobacco rod 2 and the end of the wrapped tobacco rod 2 proximate the tipping paper 6, adjacent to the laminated first band 12. The second band 22 has the same construction and function as the band 22 of the filter cigarette 20 according to the third embodiment of the invention shown in FIG. 3. The encapsulated odorant deposited on the outer surface of the paper layer 24 of the second band 22 of the filter cigarette 26 may be the same or different to the encapsulated odorant deposited between the lower paper layer and the removable upper paper layer 14 of the laminated first band 12 thereof.

In use, to release the encapsulated odorant from the laminated first band 12, the consumer separates the removable upper paper layer 14 from the remainder of the laminated first band 12 as previously described. In addition, to release the encapsulated odorant from the second band 22, the consumer rubs or scratches the outer surface of the paper layer 24 of the second band 22 as previously described. Once again, positioning of the band 22 at the end of the tipping paper 6 proximate the wrapped tobacco rod 2 advantageously allows at least some of the microcapsules deposited on the surface of the paper layer 24 to be broken through normal handling of the filter cigarette 26 by the consumer and may result in the encapsulated odorant deposited on the outer surface of the paper layer 24 of the second band 22 being advantageously transferred to the consumer's fingers during smoking of the filter cigarette 26.

The provision of a combination of both "Peel and Sniff" (laminated first band 12) and "Scratch and Sniff" (second band 22) encapsulated odorants in the fourth embodiment shown in FIG. 4 advantageously enables the consumer to release the encapsulated odorants at different stages during smoking of the filter cigarette 26. For example, the consumer may experience a first olfactory sensation prior to smoking the filter cigarette 26 by removing the upper paper layer 14 from the remainder of the laminated first band 12 to release the "Peel and Sniff" encapsulated odorant and then experience a second olfactory sensation during or after smoking by rubbing the outer surface of the paper layer 24 of the second band 22 to release the "Scratch and Sniff" encapsulated odorant.

If desired, in addition to the tipping paper 6 and the end of the wrapped tobacco rod 2 proximate thereto, the removable upper paper layer 14 of the laminated first band 12 of the filter cigarette 26 may also cover the mouth-end face of the filter 4 as in the filter cigarette 16 according to the second embodiment of the invention shown in FIG. 2.

Suitable "Peel and Sniff" laminated paper strips for use as laminated bands 12 in the filter cigarettes 10, 16 and 26 according to the first, second and fourth embodiments of the invention shown in FIGS. 1, 2 and 4, respectively, are manufactured and sold commercially, for example under the brand ScentStrip® by Arcade Marketing, Inc.

Suitable "Scratch and Sniff" paper strips for use as bands 22 in the filter cigarettes 20 and 26 according to the third and fourth embodiments of the invention shown in FIGS. 3 and 4, respectively, are manufactured and sold commercially, for example under the brand MicroFragrance® Scratch 'n' Sniff by Arcade Marketing, Inc.

The "Scratch and Sniff" bands 22 in the third and fourth embodiments of the invention shown in FIGS. 3 and 4, respectively, may alternatively be formed by applying a suspension of microcapsules directly to the outer surface of the tipping paper 6 of the filter cigarettes 20, 26 by, for example, gravure or offset printing. Suitable microcapsule suspensions are manufactured and sold commercially, for example under the brand AromaLacquer™ by Arcade Marketing, Inc.

In the filter cigarettes 16, 26 according to the second and third embodiments of the invention shown in FIGS. 1 and 4 respectively, the "Peel and Sniff" laminated bands 12 extend over the ring of perforations 18 provided in the tipping paper 6. To ensure adequate ventilation of the mainstream smoke produced during combustion of such filter cigarettes 16, 26, macro perforations may, for example, be provided in the laminated bands 12. It will be appreciated that, if necessary, perforations may also be similarly provided in bands of "Scratch and Sniff" microcapsules to ensure adequate ventilation of the mainstream smoke of smoking articles according to the invention.

While the invention has been exemplified with reference to filter cigarettes, it will be appreciated that other types of smoking article according to the invention may also be produced such as, for example, cigars, cigarillos and non-filter cigarettes.

Furthermore, while in the embodiments described above, "Scratch and Sniff" and/or "Peel and Sniff" micro-encapsulated odorants are provided on the outer surface of an "over tipping", it will be appreciated that smoking articles according to the invention may be provided with frangible microcapsules on other parts of their outer surface.

The invention claimed is:

1. An article comprising:
- a tobacco rod;
- a filter including,
  - a first end adjacent the tobacco rod, and
  - a second end;
- a tipping paper circumscribing at least a portion of the filter; and
- a laminated band including,
  - a removable upper layer, and
  - a lower paper layer, and
  - a plurality of microcapsules between the removable upper layer and the lower paper layer, the microcapsules on a portion of the tipping paper and a portion of the tobacco rod, the removable upper layer covering the portion of the tipping paper, the second end of the filter, and the portion of the tobacco rod, wherein the plurality of microcapsules are configured to be ruptured by frictional forces.

2. The article of claim 1, wherein the plurality of microcapsules includes an odorant.

3. The article of claim 1, wherein the plurality of microcapsules are frangible.

4. The article of claim 1, wherein the tipping paper defines a plurality of perforations therein.

5. The article of claim 4, wherein the laminated band covers the plurality of perforations.

6. The article of claim 4, wherein the plurality of perforations extend about the filter.

7. The article of claim 1, wherein the plurality of microcapsules has a diameter of 5 microns to 30 microns.

8. The article of claim 1, wherein the plurality of microcapsules includes tobacco, menthol, or both tobacco and menthol.

9. The article of claim 1, wherein the removable upper layer includes a tab configured to assist in removal of the removable upper layer from the lower paper layer.

10. The article of claim 1, wherein a portion of the laminated band is coplanar with a surface on the second end of the filter, the surface being perpendicular to a long axis of the filter.

11. An article comprising:
- a tobacco rod;
- a filter including,
  - a first end adjacent the tobacco rod, and
  - a second end;
- a tipping paper circumscribing at least a portion of the filter; and
- a laminated band including,
  - a removable upper layer, and
  - a lower paper layer, and
- a plurality of microcapsules between the removable upper layer and the lower paper layer in a region on both the at least the portion of the filter and a portion of the tobacco rod, the removable upper layer covering the region of the portion of the filter and the portion of the tobacco rod.

* * * * *